US005494449A

United States Patent [19]

Chioo

[11] Patent Number: 5,494,449

[45] Date of Patent: Feb. 27, 1996

[54] POWER SUPPLY DEVICE FOR PORTABLE COMPUTERS

[76] Inventor: Ming D. Chioo, 3F., No. 4, Alley 11, Lane 327, Sec. 2, Chung Shan Rd., Chung Ho City, Taipei, Taiwan

[21] Appl. No.: 299,722

[22] Filed: Sep. 1, 1994

[51] Int. Cl.[6] ..... H01R 19/16

[52] U.S. Cl. ..... 439/761; 439/131

[58] Field of Search ..... 439/171–174, 439/76, 11, 131

[56] References Cited

U.S. PATENT DOCUMENTS

| | | | |
|---|---|---|---|
| 4,997,381 | 3/1991 | Oh | 439/172 |
| 5,006,779 | 4/1991 | Fenne et al. | 439/131 |
| 5,160,879 | 11/1992 | Tortola et al. | 439/131 |
| 5,220,152 | 6/1993 | Doran | 439/131 |

*Primary Examiner*—Gary F. Paumen
*Attorney, Agent, or Firm*—Pro-Techtor International

[57] ABSTRACT

A power supply device includes a casing, a circuit board received inside the casing, a plug pivotally connected to the back of the casing, a power output terminal extended out of one end of the casing, and a receptacle mounted within an opposite end of the casing, wherein the plug can be turned between a vertical position with the rear ends of the contact prongs thereof connected to respective contact metal springs on the circuit board or a horizontal position with the rear ends of the contact prongs disconnected from the circuit board the circuit board has U-clamps for holding the rear ends of the contact prongs of the plug in the vertical position; the receptacle is electrically connected in series to the contact metal springs on the circuit board, and has a protective cover pivotally connected to the casing for entrance control.

4 Claims, 6 Drawing Sheets

POWER SUPPLY DEVICE FOR PORTABLE COMPUTERS

BACKGROUND OF THE INVENTION

The present invention relates to a power supply device for portable computers which has a plug and a receptacle for connection to a city power supply outlet alternatively.

Regular power supply devices for portable computers are generally comprised of a casing having a circuit board on the inside, a fixed plug and a power output terminal on the outside. Because the power output terminal has a limited length, the portable computer must be used within a limited area not far from the available power supply outlet. Furthermore, a regular power supply device needs much storage space when it is not in use because the plug is fixedly perpendicularly mounted on the back of the casing and cannot be collapsed.

SUMMARY OF THE INVENTION

The present invention has been accomplished under the circumstances in view. According to one aspect of the present invention, the power supply device comprises a casing having a plug for directly connected to a wall socket and a receptacle for connection to a power supply outlet by an extension cable. According to another aspect of the present invention, the plug can be alternatively turned to a horizontal position closely attached to the outside wall of the casing and disconnected from the circuit, or a vertical position to connect the circuit. According to still another aspect of the present invention, the receptacle has a protective cover pivotally connected to the casing for protection against dust when the receptacle in not in use.

DETAILED DESCRIPTION OF THE PREFERRED EMBODIMENT

Figure 1:
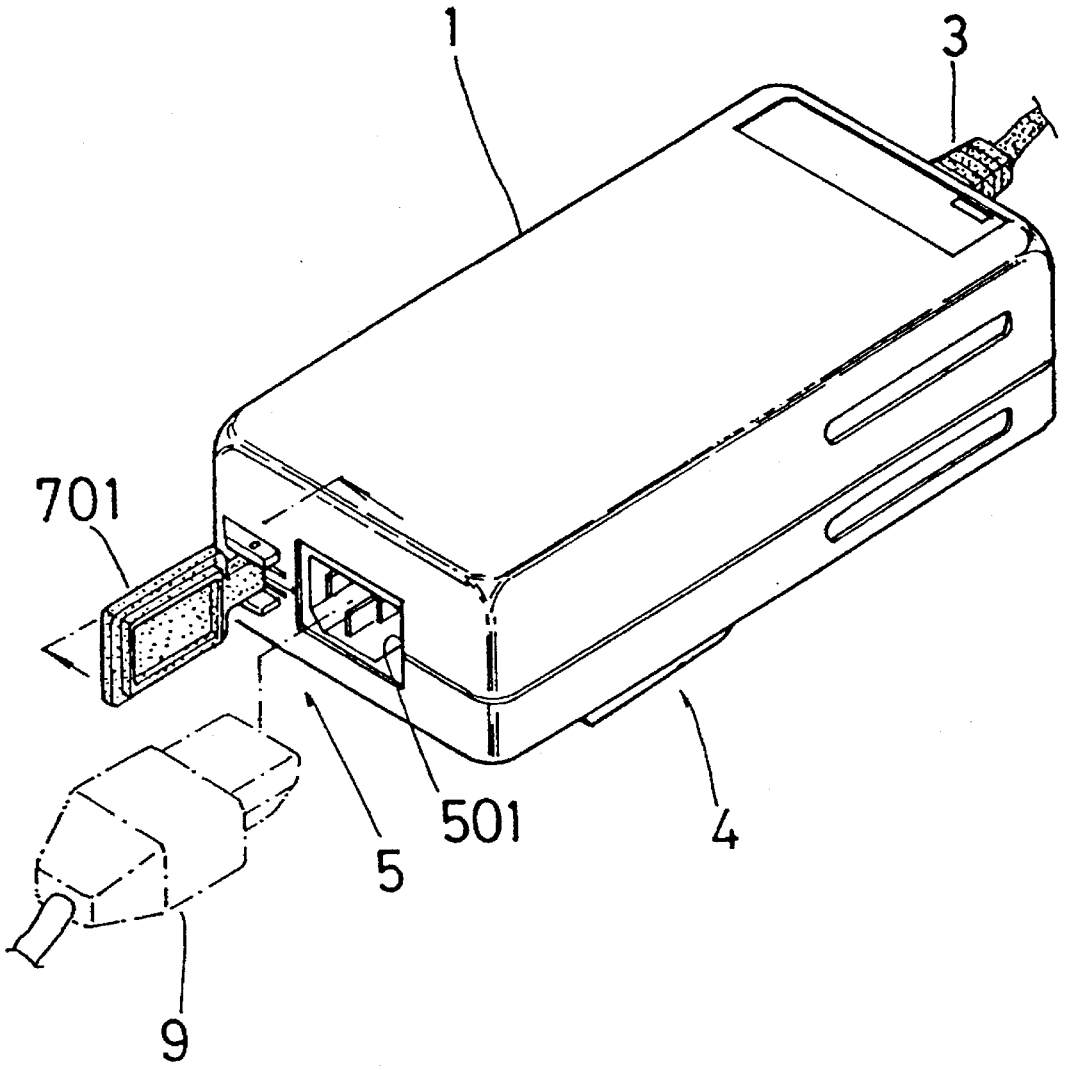
FIG. 1 is an oblique view of a power supply device according to the present invention.
Figure 2:
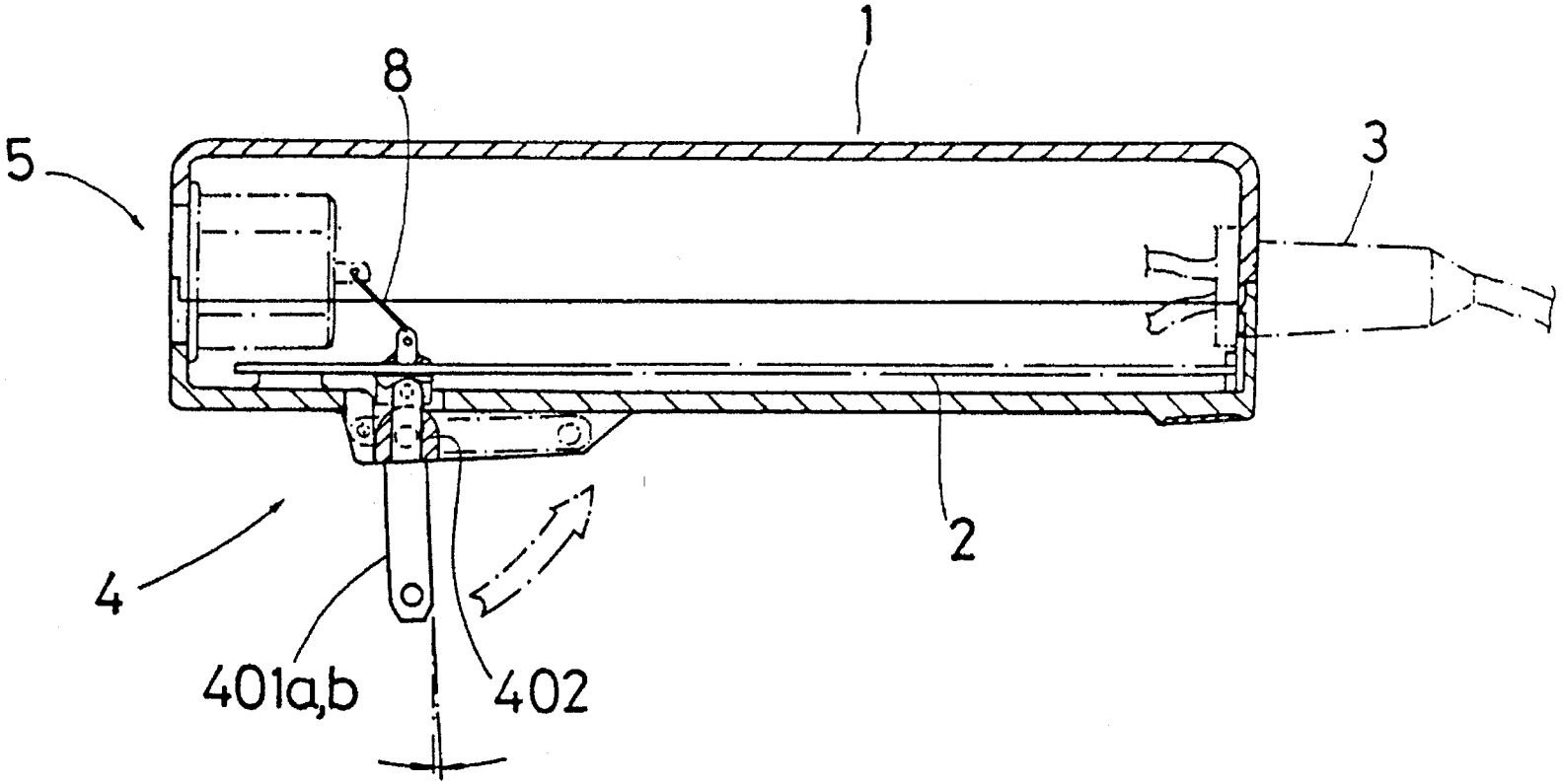
FIG. 2 is a sectional view of the power supply device shown in FIG. 1, showing the prongs turned through 90° angle.
Figure 3:
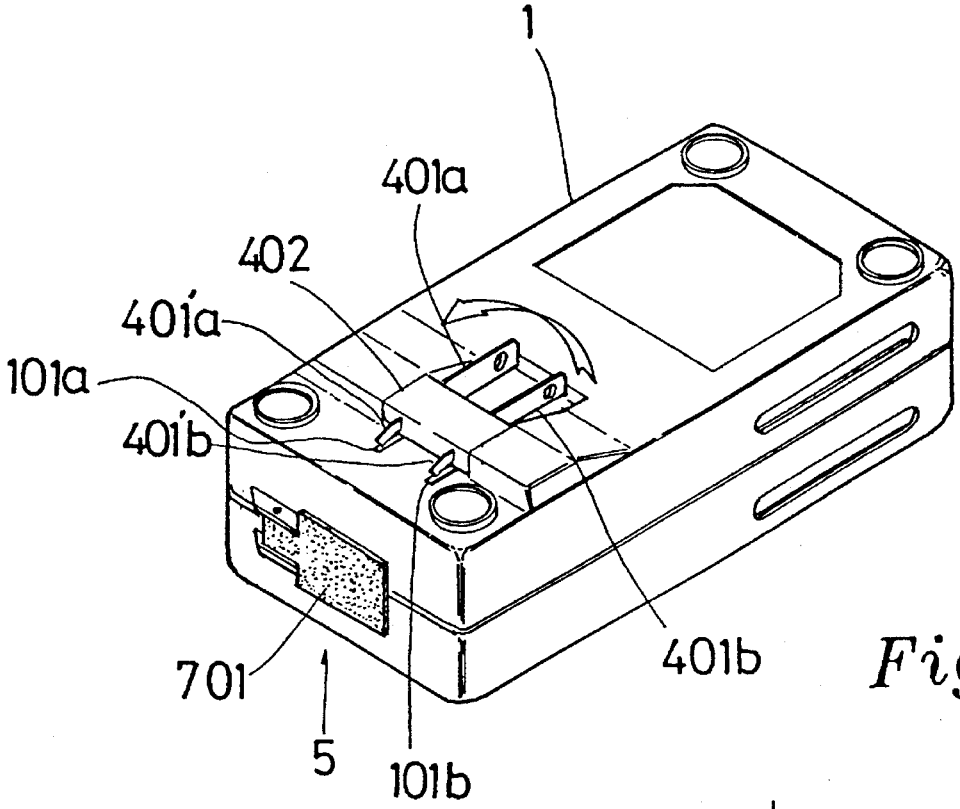
FIG. 3 is another oblique view of the power supply device of FIG. 1 when turned upside-down.

Referring to FIGS. 1, 2, and 3, a power supply device for a portable computer in accordance with the present invention is generally comprised of a casing 1, a printed circuit board 2 installed in the casing 1 and having an output terminal 3 for connection to a computer, a plug 4, and a receptacle 5.

Referring to FIGS. 2 and 3, the plug 4 comprises an insulative plug housing 402 pivotally mounted on the casing 1 on the outside, and two parallel prongs 401*a* and 401*b* fastened to the plug housing 402. The prongs 401*a* and 401*b* extend out of the plug housing 402 at one side for connection to an electric power outlet. The rear ends 401'*a* and 401'*b* of the prongs 401*a* and 401*b* extend out of the plug housing 402 at an opposite side. When the plug housing 402 is turned from a horizontal position to a vertical position relative to the casing 1, the rear ends 401'*a* and 401'*b* of the prongs 401*a* and 401*b* are inserted into holes 101*a* and 101*b* on the casing 1 and connected to respective contacts on the printed circuit board 2 (see FIG. 2).

Figure 5:
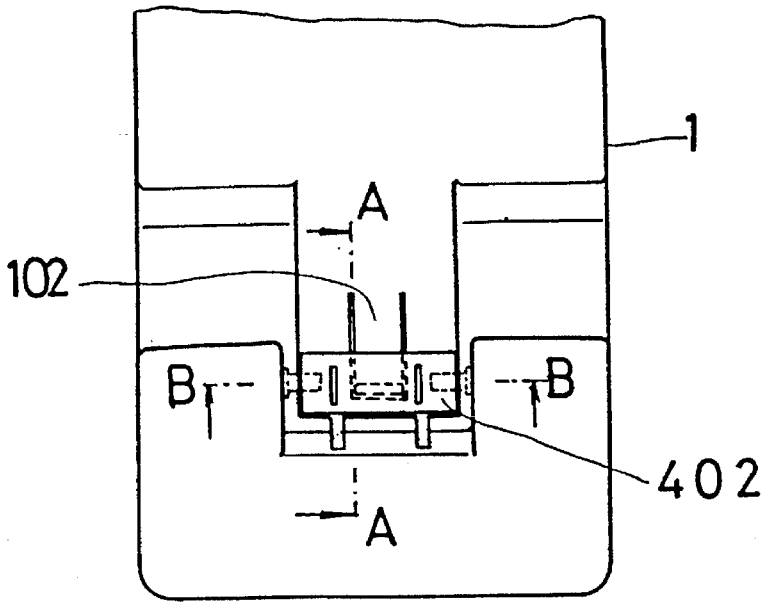
FIG. 5 is a top view taken on part of FIG. 3.
Figure 6:
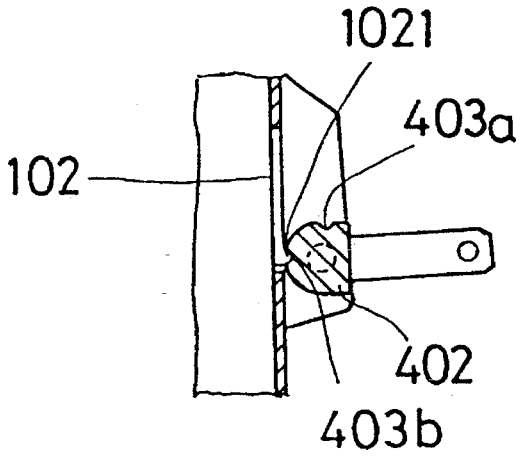
FIG. 6 is a sectional view taken on line A—A of FIG. 5 showing the prongs turned to the operative position.

Referring to FIGS. 5 and 6, the casing 1 has a tongue 102 formed on the back wall thereof right below the plug housing 402 by punching; the plug housing 402 has two recessed portions 403*a* and 403*b* arranged at right angles for engagement with the front edge 1021 of the tongue 102 alternatively permitting the plug 4 to be retained in the horizontal (non-operative) position or vertical (operative) position.

Figure 7:
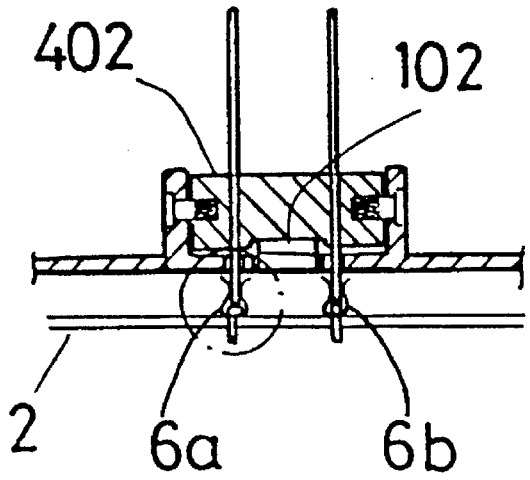
FIG. 7 is a sectional view taken on line B—B of FIG. 5.
Figures 8A, 8B:
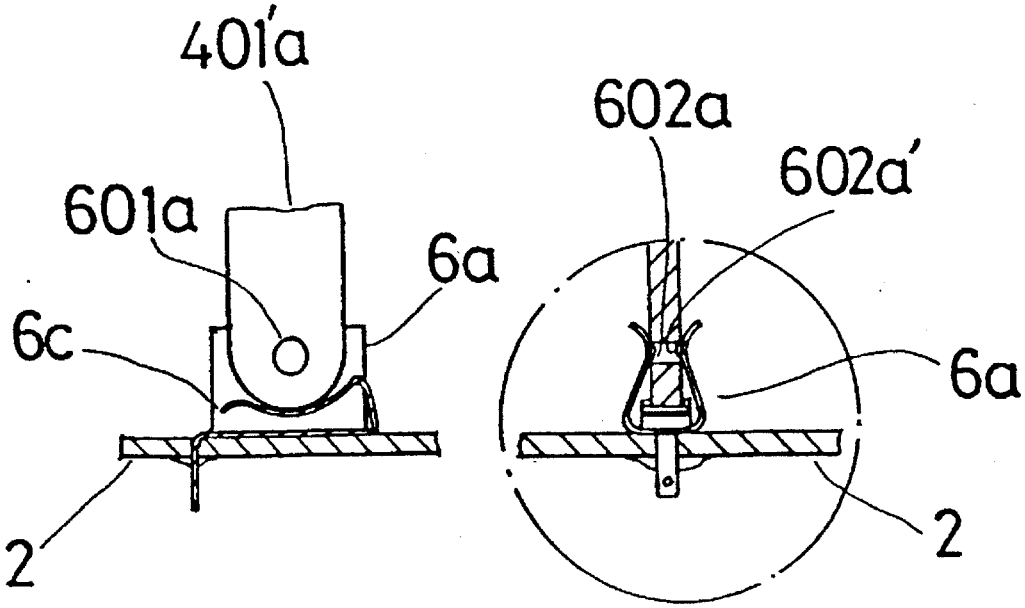
FIG. 8A is an enlarged view of the circled part of FIG. 7.
FIG. 8B is a side view of FIG. 8A.

Referring to FIGS. 7, 8A and 8B, when the prongs 401*a* and 401*b* are disposed in vertical (relative to the casing 1), the rear ends 401'*a* and 401'*b* of the prongs 401*a* and 401*b* are inserted into the holes 101*a* and 10l*b* on the casing 1 and respectively clamped by U-clamps 6*a* and 6*b* and disposed in contact with a respective metal contact spring 6*c* on the printed circuit board 2. The rear ends 401'*a* and 401'*b* have a respective hole 601*a* or 601*b* . Each U-clamp 6*a* or 6*b* has a pair of raised portions 602*a* and 602*a*'(602*b* and 602*b*') which engage the hole 601*a* or 601*b* from two opposite sides when the plug 4 is turned to the vertical (operative) position.

Figure 9:
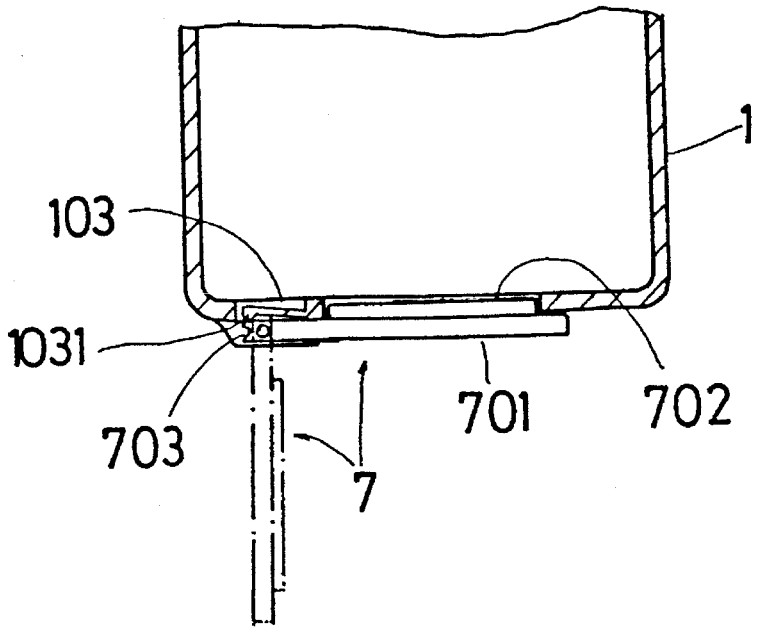
FIG. 9 is a sectional view in an enlarged scale taken on part of FIG. 1, showing the positioning of the protective cover.
Figure 10:
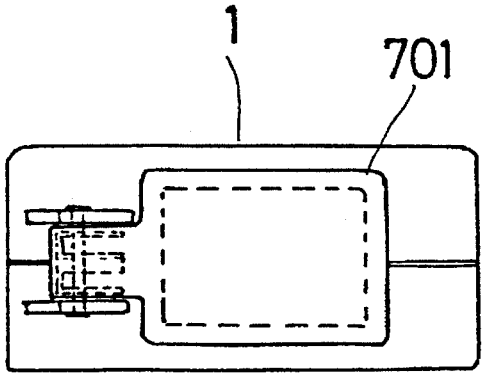
FIG. 10 is a sectional view in an enlarged view taken on the left part of FIG. 3.

Referring to FIGS. 9 and 10 and FIG. 1 again, the receptacle 5 comprises a receptacle housing 501 mounted within the casing 1 at one end opposite to the output terminal 3, two contact metal plates (not shown) disposed inside the receptacle housing 501 and connected in series to the metal contact springs 6*c* by conductors 8, and a protective cover 7 hinged to the casing 1 for covering the receptacle housing 501. The protective cover 7 comprises a cover board 701 hinged to the casing 1 by a hinge (not shown). The cover board 701 comprises a flat back flange 702 raised from the back side thereof and a back recess 703 spaced from the flat back flange 702 by the hinge. When the protective cover 7 is closed, the back flange 702 fitted into the front opening of the receptacle housing 501 to seal the entrance. When the protective cover 7 is opened, the front edge 1031 of a tongue 103, which is made on the casing 1 by punching, engages the back recess 703 to hold the protective cover 7 in position.

Figure 4:
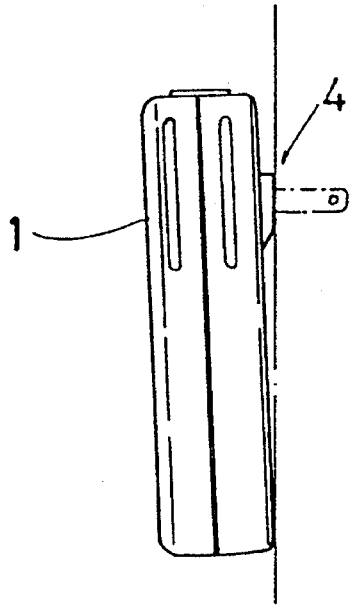
FIG. 4 shows the power supply device of FIG. 1 fastened to a wall socket.

Referring to FIGS. 2 and 3 again, when the plug 4 is turned from the horizontal position to the vertical position, the rear ends 401'*a* and 401'*b* of the prongs 401*a* and 401*b* are inserted into the holes 101*a* and 10l*b* on the casing 1 and respectively clamped by U-clamps 6*a* and 6*b* and disposed in contact with the metal contact springs 6*c* on the printed circuit board 2, and the front edge 1021 of the tongue 102 engages the recessed portion 403*b* (see FIG. 6) to hold the plug 4 in the operative position, and therefore the power supply device can be fastened to a wall socket (see FIG. 4) for transmission of city power supply to a computer (not shown) through the output terminal 3.

The receptacle 5 of the power supply device can be connected to a city power supply outlet by a power cable. Before using the receptacle 5, the plug 4 must be turned from the vertical position to the horizontal position permitting the front edge 1021 of the tongue 102 to engage the recessed portion 403*a*, then the protective cover 701 is turned outwards through 90° angle to open the receptacle housing 501 for receiving the plug 9 of a power cable (see FIG. 1).

What is claimed is:

1. A power supply device comprising a casing, a circuit board mounted inside said casing, a receptacle mounted within said casing for connection to a power supply outlet by a power cable, a plug mounted outside said casing for connection to a power supply outlet socket, and a power output terminal for connection to the power input terminal of a computer, wherein:

said casing comprises a first opening defining a first tongue adjacent to said plug, and a second opening defining a second tongue adjacent to said receptacle;

said circuit board comprises two U-clamps and two contact metal springs, said contact metal springs being connected to said power output terminal and said receptacle by conductors;

said plug comprises a plug housing having two parallel contact prongs and pivotally fastened to said casing on the outside thereof by a pivot and turnable through a 90° angle to hold said contact prongs in a vertical position or a horizontal position relative to said casing, said plug housing having two recessed portions arranged at right angles for engagement with said first tongue alternatively, permitting said contact prongs to be retained in said vertical position or said horizontal position, said contact prongs each having a respective rear contact end, the rear contact ends of said contact prongs being inserted into said first opening and retained in contact with said contact metal springs by said U-clamps when turned by said plug housing to said vertical position; and said receptacle comprises a receptacle housing connected to said contact metal springs, and a cover hinged to said casing and turned in either direction between a closed position covered on said receptacle housing and an open position removed from said receptacle housing, said cover having a back recess for engagement with said second tongue permitting said cover to be retained in said open position.

2. The power supply device of claim 1 wherein the rear contact ends of said contact prongs each have a respective retaining hole; said U-clamps each have two raised portions, which engage the retaining holes on the rear contact ends of said contact prongs from two opposite sides when said contact prongs are turned to said vertical position.

3. The power supply device of claim 1 wherein said contact metal springs are respectively integrally made on said U-clamps.

4. The power supply device of claim 1 wherein said protective cover has a flat back flange, which fits into said receptacle housing when said protective cover is closed.

* * * * *